US011548750B2

(12) United States Patent
Kinoshita et al.

(10) Patent No.: US 11,548,750 B2
(45) Date of Patent: Jan. 10, 2023

(54) POST-PROCESSING APPARATUS AND IMAGE FORMING APPARATUS

(71) Applicant: FUJIFILM Business Innovation Corp., Tokyo (JP)

(72) Inventors: Shoya Kinoshita, Kanagawa (JP); Jun Noguchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/378,755

(22) Filed: Jul. 18, 2021

(65) Prior Publication Data

US 2022/0259001 A1 Aug. 18, 2022

(30) Foreign Application Priority Data

Feb. 17, 2021 (JP) ..... JP2021-023641

(51) Int. Cl.
*B65H 37/04* (2006.01)
*B42C 1/12* (2006.01)

(52) U.S. Cl.
CPC ..... *B65H 37/04* (2013.01); *B42C 1/12* (2013.01); *B65H 2405/3521* (2013.01)

(58) Field of Classification Search
CPC ... B42C 1/12; B31F 5/001; B31F 5/02; B65H 2405/3521; B65H 2408/122; B65H 2408/1222; B41L 43/12
See application file for complete search history.

(56) References Cited

U.S. PATENT DOCUMENTS 8,870,176 B2 * 10/2014 Yamamoto ..... G03G 15/6544 270/58.11
10,077,165 B2 * 9/2018 Ahn ..... B41L 43/12
10,632,644 B2 * 4/2020 Lee ..... B27F 7/17
10,987,964 B2 * 4/2021 Noguchi ..... B65H 29/12
2015/0338814 A1 * 11/2015 Shirasaki ..... B42B 4/00 412/33
2017/0233213 A1 * 8/2017 Ahn ..... B65H 37/04 412/33
2019/0291496 A1 * 9/2019 Noguchi ..... G03G 15/6541

FOREIGN PATENT DOCUMENTS

JP 2019167194 10/2019

* cited by examiner

*Primary Examiner* — Leslie A Nicholson, III
(74) *Attorney, Agent, or Firm* — JCIPRNET

(57) ABSTRACT

A post-processing apparatus includes: a binding device that performs a binding process on a bundle of sheets; a guide rail for moving the binding device; and a rotation mechanism that is arranged at a position adjacent to the guide rail and rotates the binding device that has moved on the guide rail along with movement of the binding device.

6 Claims, 13 Drawing Sheets

POST-PROCESSING APPARATUS AND IMAGE FORMING APPARATUS

CROSS-REFERENCE TO RELATED APPLICATIONS

This application is based on and claims priority under 35 USC 119 from Japanese Patent Application No. 2021-023641 filed Feb. 17, 2021.

BACKGROUND

(i) Technical Field

The present invention relates to a post-processing apparatus and an image forming apparatus.

(ii) Related Art

JP2019-167194A discloses a post-processing apparatus including: a first binding unit 90 that binds sheets and moves while rotating a first gear 97; a second binding unit 70 that binds sheets and moves while rotating a second gear 77; a common path 521 that is a path on which the first binding unit and the second binding unit move; a first rack gear 54 that is provided along the common path and meshing with the first gear; and a second rack gear 53 that is provided along the common path, is provided on a side opposite to the first rack gear with the common path interposed therebetween, and meshes with the second gear.

SUMMARY

Aspects of non-limiting embodiments of the present disclosure relate to a post-processing apparatus and an image forming apparatus that enable oblique binding by obliquely rotating a binding device even in a case where a guide rail for moving the binding device is linear.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a post-processing apparatus including: a binding device that performs a binding process on a bundle of sheets; a guide rail for moving the binding device; and a rotation mechanism that is arranged at a position adjacent to the guide rail and rotates the binding device that has moved on the guide rail along with movement of the binding device.

BRIEF DESCRIPTION OF THE DRAWINGS

Exemplary embodiment(s) of the present invention will be described in detail based on the following figures, wherein.

DETAILED DESCRIPTION

Figure 1:
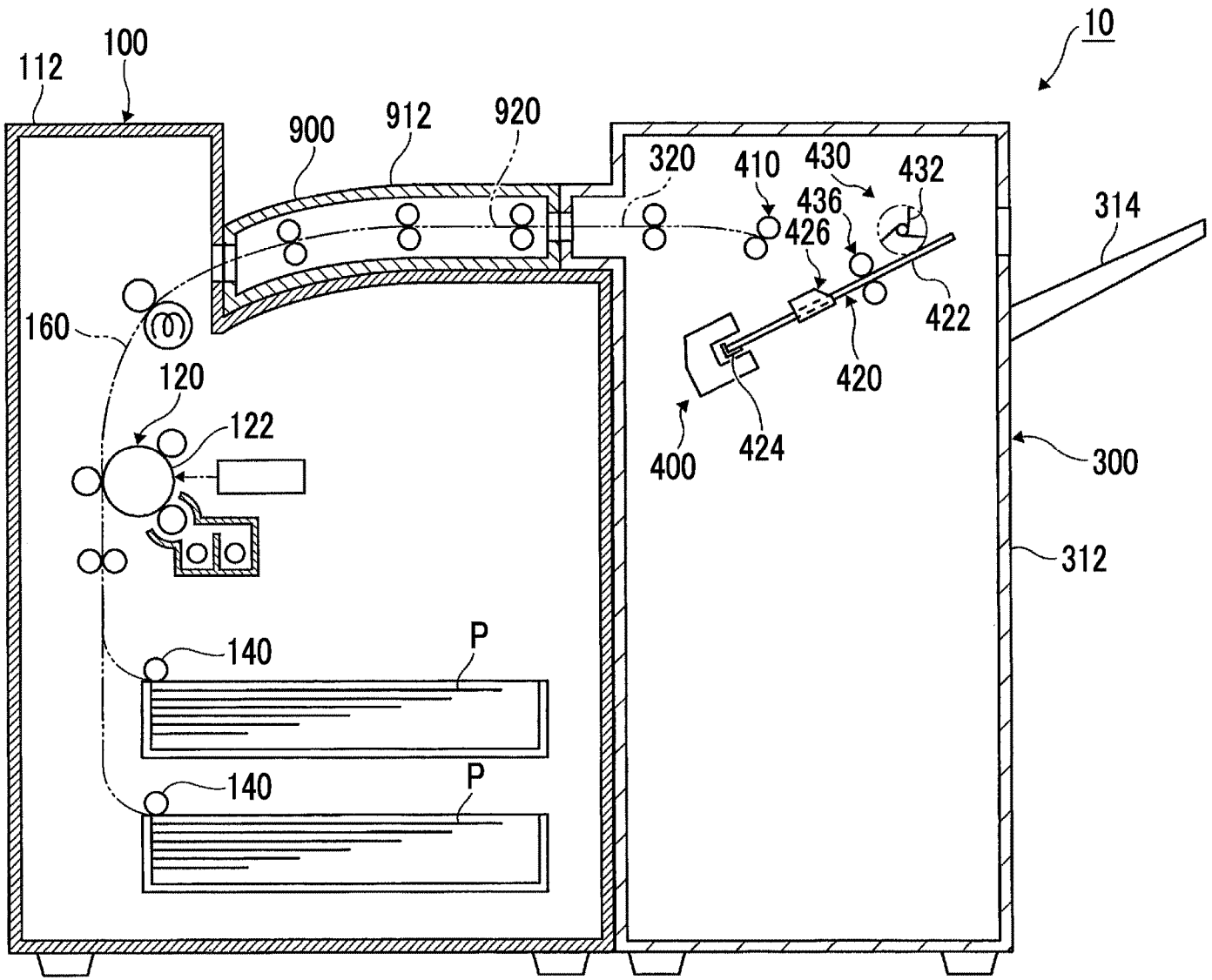
FIG. 1 is a diagram showing a cross section of an image forming apparatus used in an exemplary embodiment of the present invention.

Next, a mode for carrying out the present invention will be described with reference to the drawings. FIG. 1 is a cross-sectional view showing an image forming apparatus 10 used in an exemplary embodiment of the present invention from the front side. As shown in FIG. 1, the image forming apparatus 10 includes an image forming unit 100, a post-processing unit 300 which is a post-processing apparatus, and a transport unit 900.

The image forming unit 100 has an image forming unit body 112, and an image forming portion 120 and, for example, two supply devices 140 are arranged in the image forming unit body 112. A transport passage 160 is formed in the image forming unit body 112.

The image forming portion 120 forms an image on a sheet P, which is an example of a recording medium and is an example of paper. The image forming portion 120 adopts an electrophotographic method, develops a latent image formed on the surface of a photosensitive drum 122 with toner to form a toner image, transfers the toner image to the sheet P, and fixes the toner image transferred to the sheet P on the sheet P, thereby forming the image on the sheet P. Instead of adopting the electrophotographic method for the image forming portion 120, another method such as an ink jet method may be adopted.

The supply device 140 supplies sheets P stored in a stacked state to the image forming portion 120 sheet by sheet.

On the transport passage 160, the sheet P supplied from the supply device 140 is transported to the image forming portion 120, and the sheet P on which the image is formed by the image forming portion 120 is transported so as to be discharged from the image forming unit body 112.

The post-processing unit 300 has a post-processing unit body 312, and a binding process unit 400 is arranged in the post-processing unit body 312. The binding process unit 400 is a device that binds the sheets P, and binds plural sheets P into a bundle. Details of the binding process unit 400 will be described later.

A discharge portion 314 to which the sheets P bound by the binding process unit 400 are discharged is mounted on the post-processing unit body 312.

A transport passage 320 is formed in the post-processing unit body 312. On the transport passage 320, the sheet P that has been transported into the post-processing unit body 312 is transported to the binding process unit 400.

The transport unit 900 has a transport unit body 912, and a transport passage 920 is formed in the transport unit body 912. On the transport passage 920, the sheet P discharged from the image forming unit body 112 is transported into the post-processing unit body 312. A perforating device (not shown) for perforating the sheet P may be arranged in the transport unit 900.

As shown in FIG. 1, the binding process unit 400 has a pair of receiving rolls 410. The pair of receiving rolls 410 are an example of a receiving unit, and receive the sheet P that has been transported from the transport unit 900. The pair of receiving rolls 410 are arranged along the transport passage 320.

The binding process unit 400 further includes a loading portion 420. The loading portion 420 is an example of a loading unit, and plural sheets P supplied from the receiving rolls 410 are loaded on the loading portion 420. The loading portion 420 has a loading plate 422 and an abutting member 424.

The loading plate 422 is inclined so that the end portion on the abutting member 424 side is located lower in the gravity direction than the end portion on the side opposite to the abutting member 424, and plural sheets P are loaded on the upper surface in the gravity direction. The rear end portion of the plural sheets P in the transport direction abuts the abutting member 424. Since the rear end portion thereof abuts the abutting member 424, the plural sheets P are aligned in the transport direction.

The binding process unit 400 further includes an aligning device 426. The aligning device 426 aligns the plural sheets P in a direction intersecting the transport direction by sandwiching the plural sheets P between a pair of aligning plates.

The binding process unit 400 further includes a pressing device 430. The pressing device 430 has, for example, three blade portions 432, and presses the sheets P by the rotation of the blade portions 432 so that the rear end portion of the sheets P abut the abutting member 424.

The binding process unit 400 further includes a discharge device 436. The discharge device 436 has a pair of rolls, and discharges plural sheets P after being bound to the outside of the post-processing unit body 312 by rotating the pair of rolls.

Figure 2:
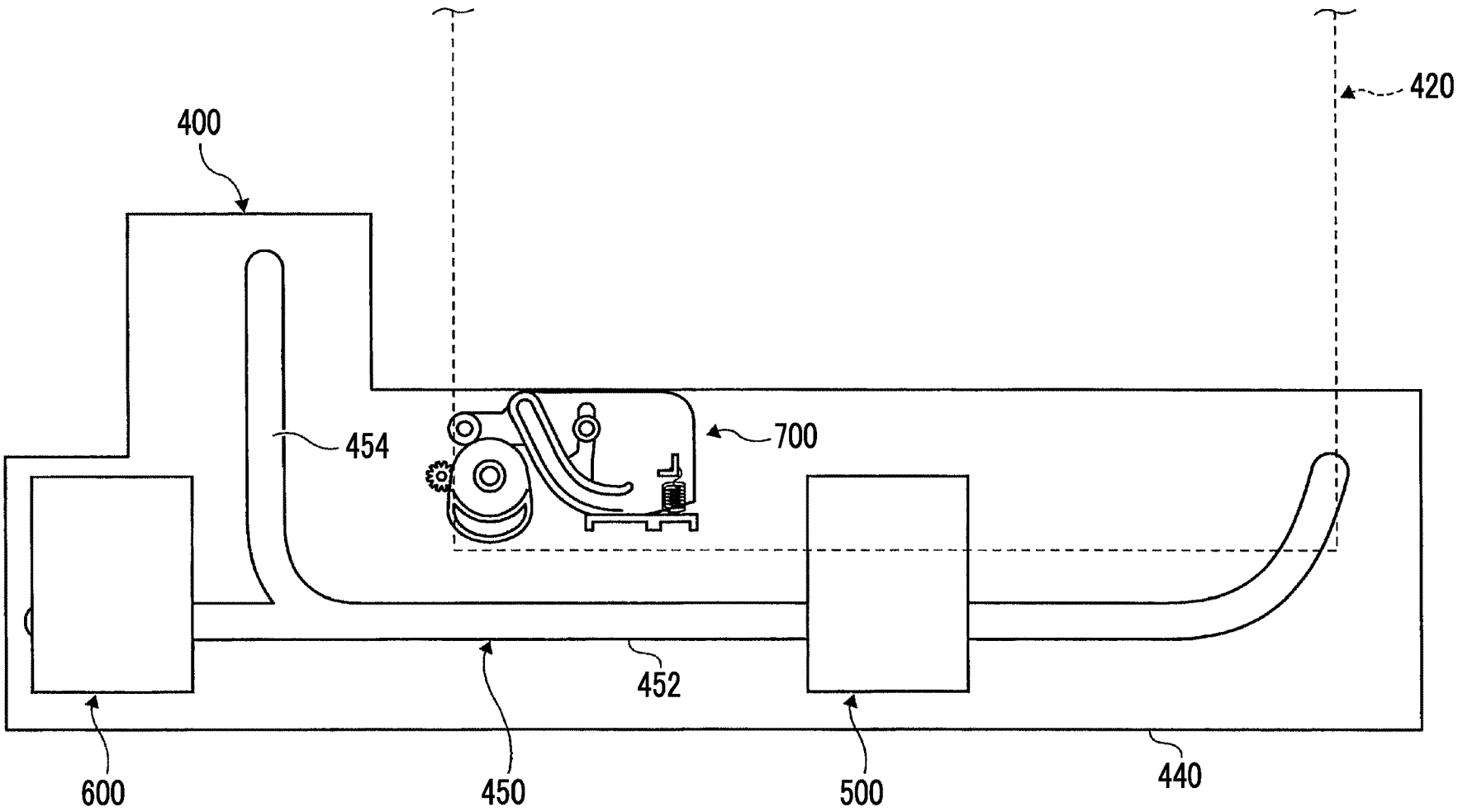
FIG. 2 is a diagram showing a part of the configuration of a binding process unit in a post-processing apparatus included in the image forming apparatus shown in FIG. 1.

FIG. 2 is a schematic view showing a part of the configuration of the binding process unit 400, in which the right side in FIG. 2 shows the front side of the image forming apparatus 10, and the left side in FIG. 2 shows the rear side of the image forming apparatus 10.

The binding process unit 400 further has a needle-attached binding device 500 as a first binding device, a needleless binding device 600 as a second binding device that performs a different binding process from the first binding device, and a support plate 440 that supports the needle-attached binding device 500 and the needleless binding device 600.

Here, the needle-attached binding device 500 performs the binding process on a bundle of sheets using a needle, which is an example of a binding member. The needleless binding device 600 performs the binding process by pressing the bundle of sheets without using a needle.

In the support plate 440, a guide rail 450 for moving the needle-attached binding device 500 and the needleless binding device 600 in predetermined directions is formed. The guide rail 450 has a first guide rail 452 and a second guide rail 454 branched to the right side (upper side in FIG. 2) from the first guide rail 452.

Figure 3:
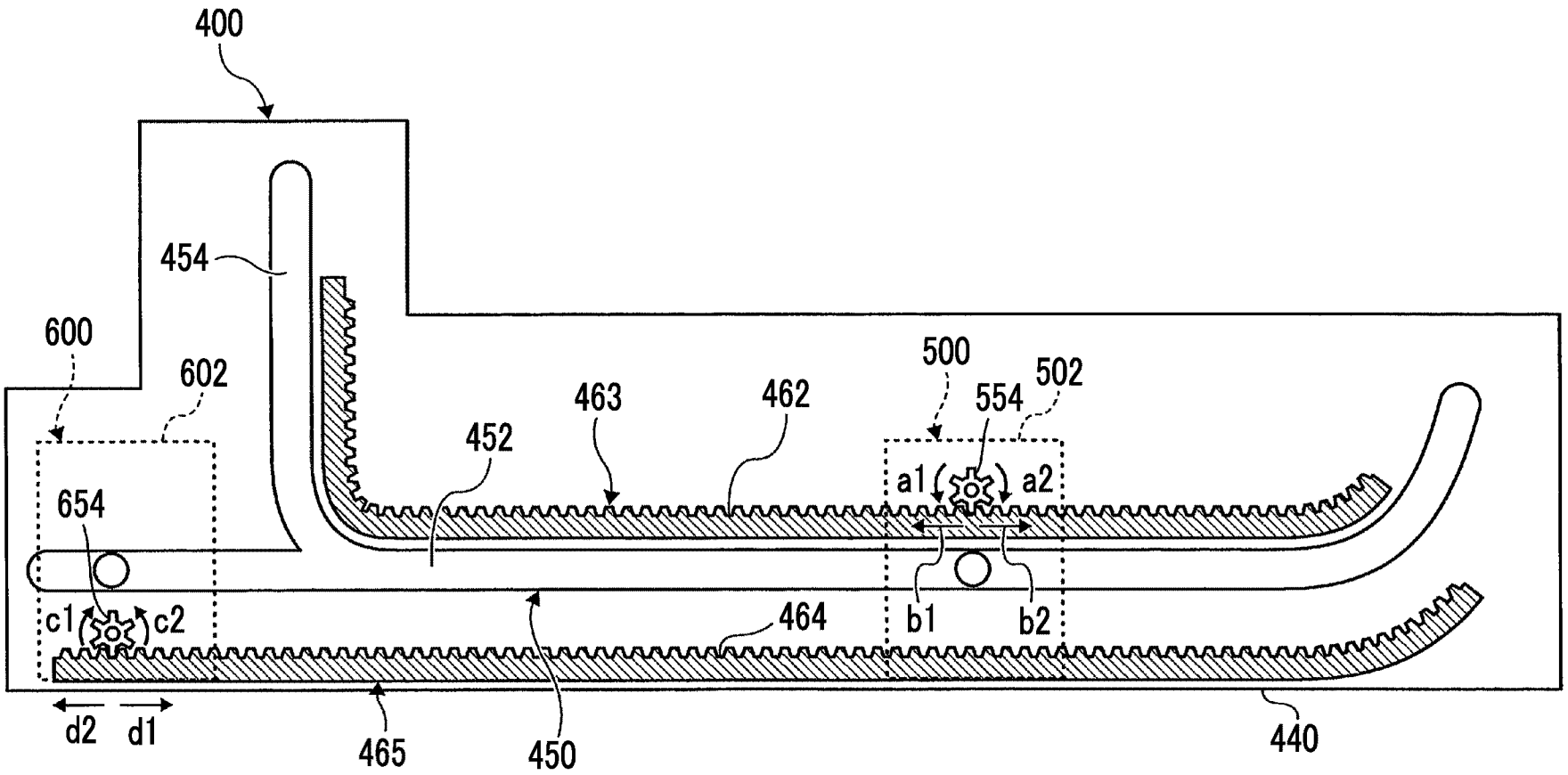
FIG. 3 is a schematic view describing the configuration of a guide rail of the binding process unit shown in FIG. 2.

FIG. 3 is a schematic view for describing the configuration of the rear surface side of the support plate 440. As shown in FIG. 3, the support plate 440 is provided with a rail member 465 having a row of teeth 464 formed below the first guide rail 452 in FIG. 3 along the first guide rail 452.

In addition, the support plate 440 is provided with a rail member 463 having a row of teeth 462 formed above the first guide rail 452 and the second guide rail 454 in FIG. 3 along the first guide rail 452 and the second guide rail 454 branched from the first guide rail 452.

The needle-attached binding device 500 has a moving drive mechanism, and transmits the driving from the moving drive source to a gear member 554 to rotate the gear member 554. The row of teeth of the gear member 554 meshes with the row of teeth 462 (see FIG. 3) of the rail member 463 arranged along the first guide rail 452 and the second guide rail 454. As the gear member 554 rotates in an arrow a1 direction, the needle-attached binding device 500 moves in an arrow b1 direction. In addition, as the gear member 554 rotates in an arrow a2 direction, the needle-attached binding device 500 moves in an arrow b2 direction.

The needleless binding device 600 has a moving drive mechanism, and transmits the driving from the moving drive source to a gear member 654 to rotate the gear member 654. The row of teeth of the gear member 654 meshes with the row of teeth 464 (see FIG. 3) of the rail member 465 arranged along the first guide rail 452. As the gear member 654 rotates in an arrow c1 direction, the needleless binding device 600 moves in an arrow d1 direction. In addition, as the gear member 654 rotates in an arrow c2 direction, the needleless binding device 600 moves in an arrow d2 direction.

The needle-attached binding device 500 and the needleless binding device 600 are rotatably attached to pedestals 502 and 602 that move on the guide rail 450, respectively, via rotating tables 504 and 604, which will be described later. As will be described in detail later, guide pins 506 and 606, which are examples of guide members, are fixed to the lower surfaces of the rotating tables 504 and 604, respectively.

Figure 4:
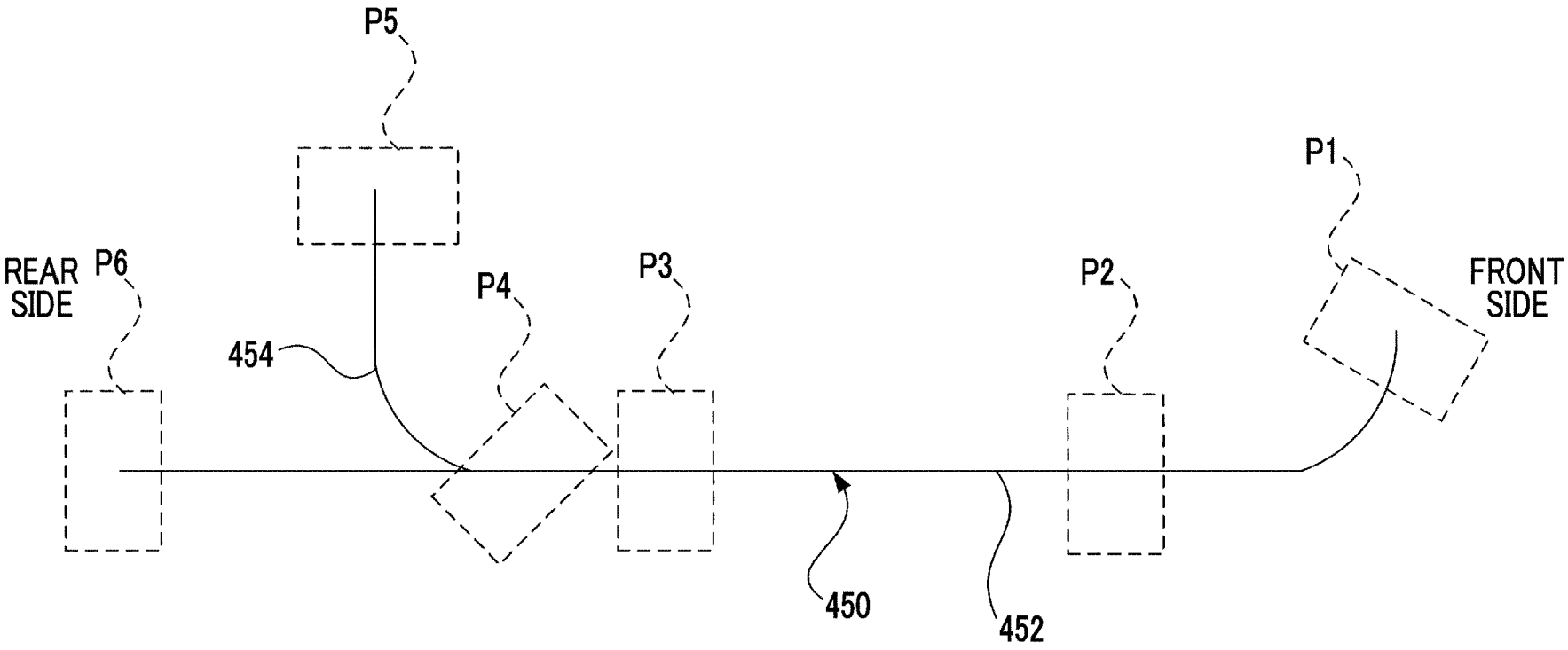
FIG. 4 is a diagram showing a binding position of a binding device in the binding process unit shown in FIG. 2.

The guide rail 450 guides the movement of the needle-attached binding device 500 between a position P1, a position P2, a position P3, a position P4, and a position P5 shown in FIG. 4. In addition, the guide rail 450 guides the movement of the needleless binding device 600 between the position P1, the position P2, the position P3, the position P4, and a position P6 shown in FIG. 4.

The position P5 is an example of a waiting place in which the needle-attached binding device 500 waits until the binding process by the needleless binding device 600 ends. Therefore, in the following description, the position P5 is referred to as a waiting place P5.

Further, the position P6 is an example of a waiting place where the needleless binding device 600 waits until the binding process by the needle-attached binding device 500 is completed. Therefore, in the following description, the position P6 is referred to as a waiting place P6.

That is, either one of the needle-attached binding device 500 or the needleless binding device 600 waits at the waiting place P5 or the waiting place P6, and the other is moved to any of the binding position P1, the position P2, the position P3, and the position P4 to perform the binding process.

Figure 5:
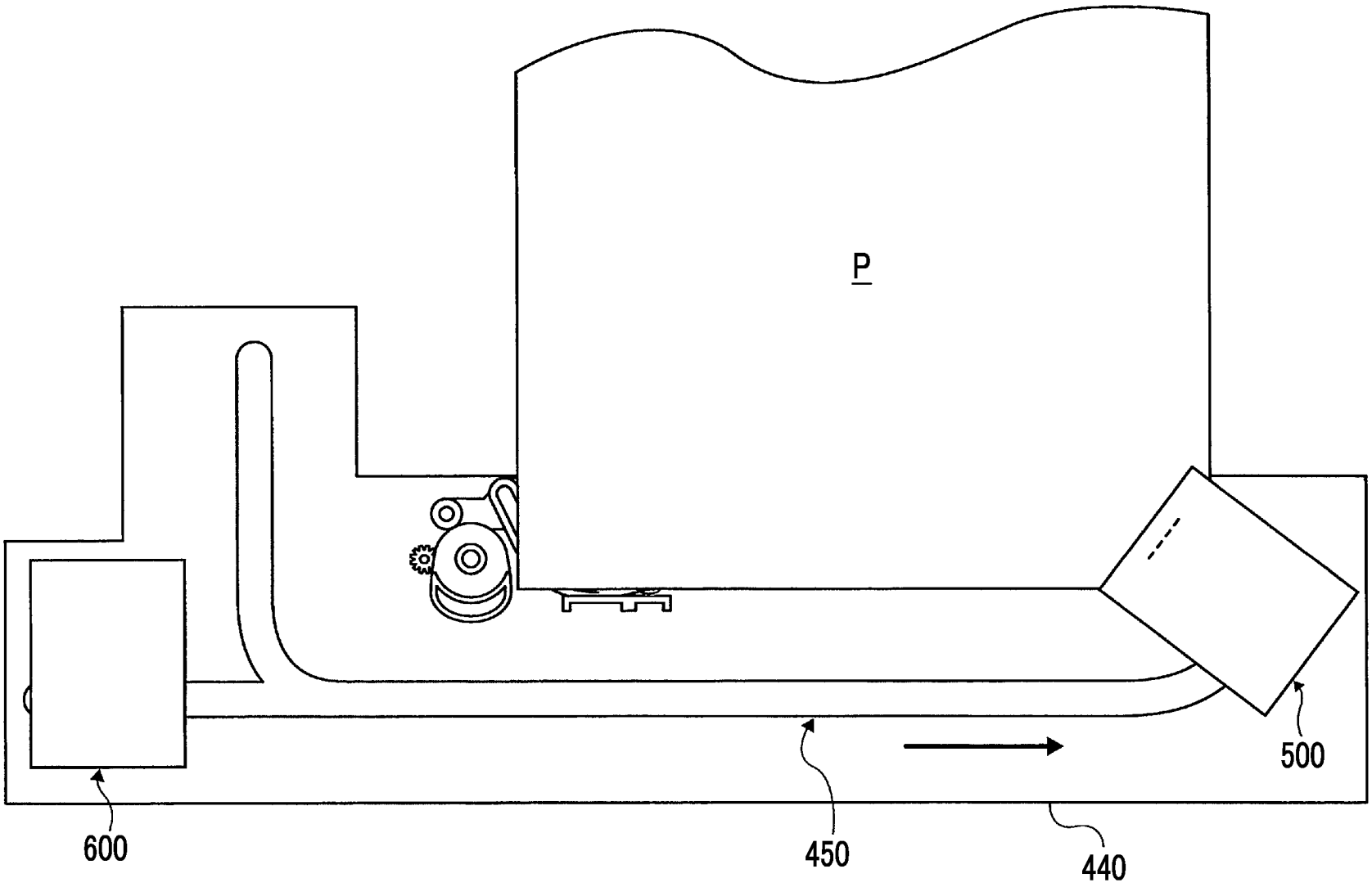
FIG. 5 is a schematic view for describing an operation of the binding device in a case of binding a bundle of sheets at a position P1.

FIG. 5 is a diagram for describing the positions of the needle-attached binding device 500 and the needleless binding device 600 in a case where a bundle of sheets P on the front side of the image forming apparatus 10 is obliquely bound using the needle-attached binding device 500.

As shown in FIG. 5, the needleless binding device 600 waits at the waiting place P6, and the needle-attached binding device 500 moves along the guide rail 450, stops at the position P1 where the guide rail 450 is curved, and performs binding process on the bundle of sheets P.

Similarly, in a case where the bundle of sheets P on the front side of the image forming apparatus 10 is obliquely bound using the needleless binding device 600, the needle-attached binding device 500 waits at the waiting place P5, and the needleless binding device 600 moves along the guide rail 450, stops at the position P1 where the guide rail 450 is curved, and performs the binding process on the bundle of sheets P.

Figure 6:
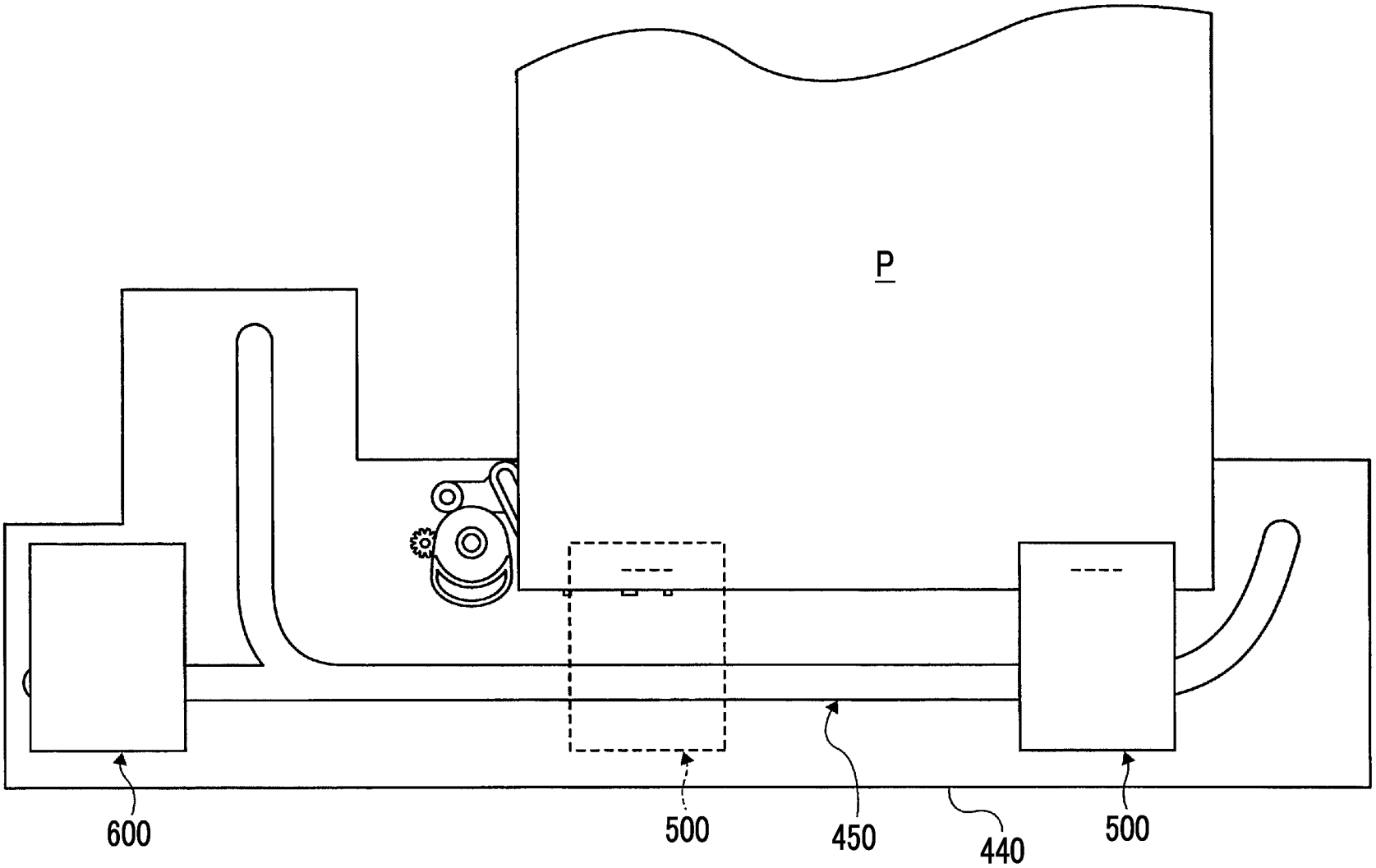
FIG. 6 is a schematic view for describing an operation of the binding device in a case of binding a bundle of sheets at a position P2 and a position P3.

FIG. 6 is a diagram for describing the positions of the needle-attached binding device 500 and the needleless binding device 600 in a case where the bundle of sheets P is straightly bound using the needle-attached binding device 500.

As shown in FIG. 6, the needleless binding device 600 waits at the waiting place P6, and the needle-attached binding device 500 moves along the guide rail 450, stops at the position P2 and the position P3 where the guide rail 450 is linear, and performs the binding process on the bundle of sheets P.

Similarly, in a case where the bundle of sheets P is straightly bound using the needleless binding device 600, the needle-attached binding device 500 waits at the waiting place P5, and the needleless binding device 600 moves along the guide rail 450, stops at the position P2 and the position P3 where the guide rail 450 is linear, and performs the binding process on the bundle of sheets P.

Figure 7:
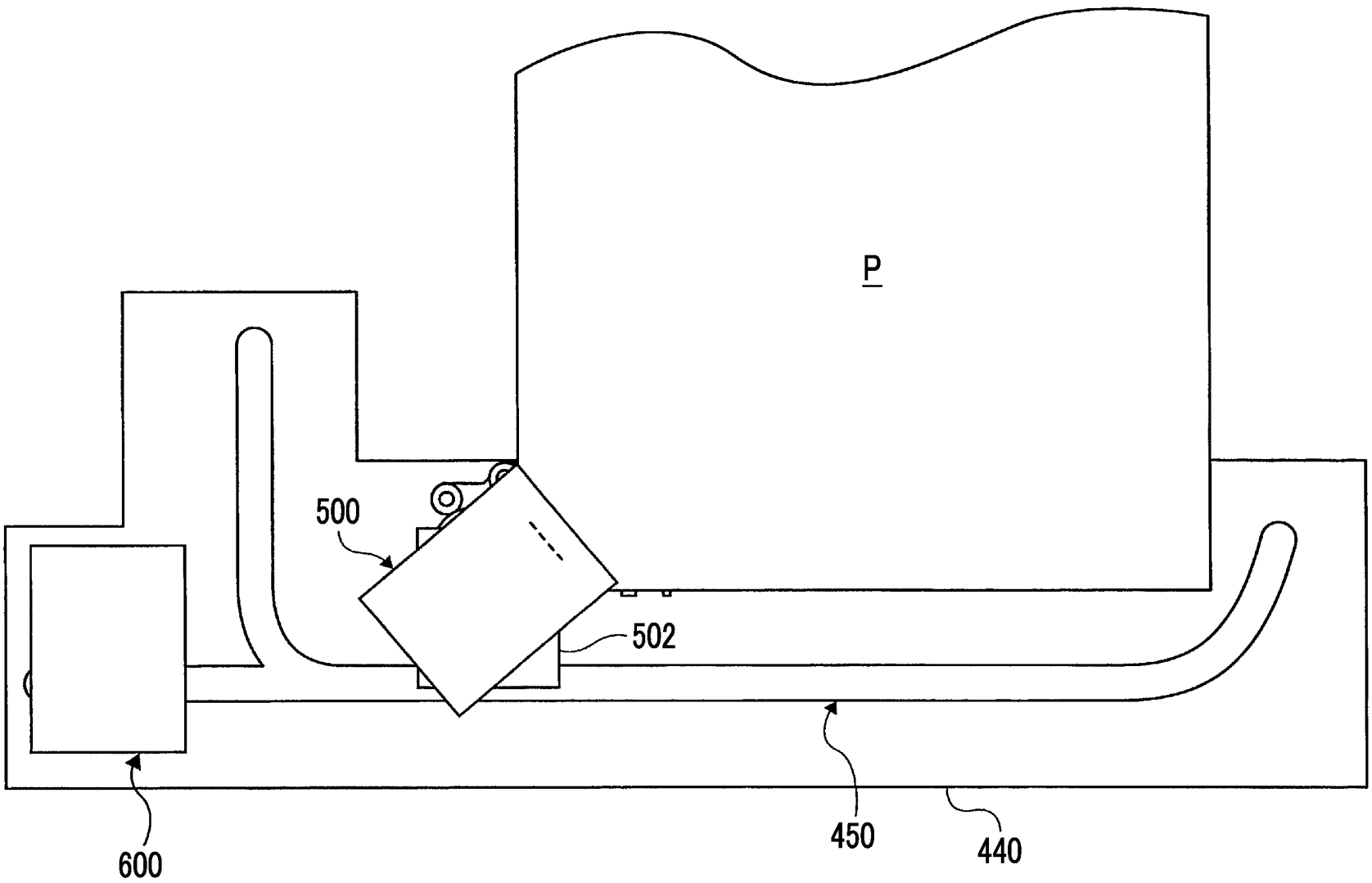
FIG. 7 is a schematic view for describing an operation of the binding device in a case of binding a bundle of sheets at a position P4.

FIG. 7 is a diagram for describing the positions of the needle-attached binding device 500 and the needleless binding device 600 in a case where the bundle of sheets P on the rear side of the image forming apparatus 10 is obliquely bound using the needle-attached binding device 500.

As shown in FIG. 7, the needleless binding device 600 waits at the waiting place P6, and the needle-attached binding device 500 moves from the front side to the rear side along the guide rail 450. Here, as the needle-attached binding device 500 moves, the guide pin 506 fixed to the lower surface of the rotating table 504 of the needle-attached binding device 500 is guided and rotated by a rotation mechanism 700, which will be described later in detail, and stops at the binding position P4, and the binding process for obliquely binding the bundle of sheets P is performed.

Similarly, in a case where the bundle of sheets P on the rear side of the image forming apparatus 10 is obliquely bound using the needleless binding device 600, the needle-attached binding device 500 waits at the waiting place P5, and the needleless binding device 600 moves from the front side to the rear side along the guide rail 450. Here, as the needleless binding device 600 moves, the guide pin 606 fixed to the lower surface of the rotating table 604 of the needleless binding device 600 is guided and rotated by THE rotation mechanism 700, which will be described later in detail, and stops at the binding position P4, and the binding process for obliquely binding the bundle of sheets P is performed.

In the image forming apparatus 10 configured as described above, a bundle of plural sheets Ps can be bound using the needle-attached binding device 500, or a bundle of plural sheets Ps can be bound using the needleless binding device 600.

The image forming apparatus 10 further has an opening/closing portion. The opening/closing portion is mounted on the surface of the post-processing unit body 312 on the front side (the right side in FIGS. 4 and 5). In a case where the needle-attached binding device 500 is arranged at the position P1, by opening the opening/closing portion, the needle-attached binding device 500 can be visually recognized from the outside of the post-processing unit body 312, the needle-attached binding device 500 can be replenished with needles, and the amount of remaining needles in the needle-attached binding device 500 can be checked.

Figure 8:
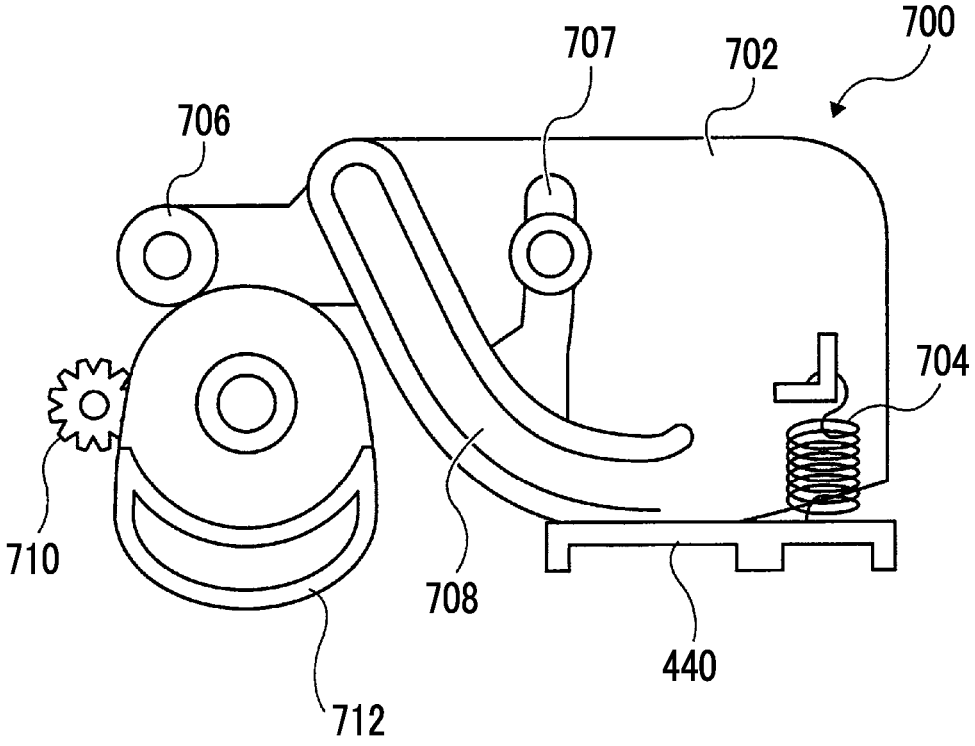
FIG. 8 is a diagram showing the configuration of a rotation mechanism in the binding process unit in the present exemplary embodiment.

FIG. 8 is a diagram showing details of the rotation mechanism 700.

The rotation mechanism 700 includes a rotation mechanism body 702, a biasing member 704 that biases the rotation mechanism body 702 and the support plate 440, a shaft portion 706, and a guide groove 708 that guides the guide pin 506 or the guide pin 606, and a limiting portion 707 that limits the movement of the rotation mechanism body 702. The rotation mechanism body 702 and the guide groove 708 are formed integrally with each other.

The guide groove 708 is an R-shaped groove in which one end is open and the other end is closed and is specifically provided so that the front side of the image forming apparatus 10 is open and the rear side is closed. The guide groove 708 is used as a guide mechanism that guides the guide pins 506 and 606 to the position P4 that is the binding position.

Figure 9A:
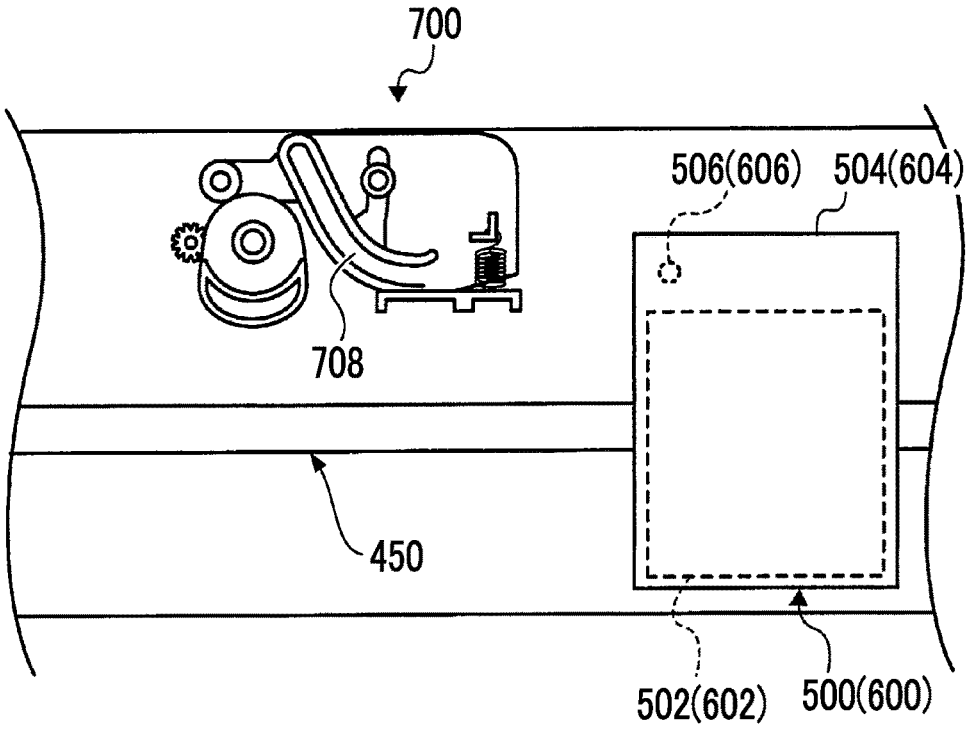
FIGS. 9A and 9B are schematic views for describing the operation of the binding device in the case of binding a bundle of sheets at the position P4.
Figure 9B:
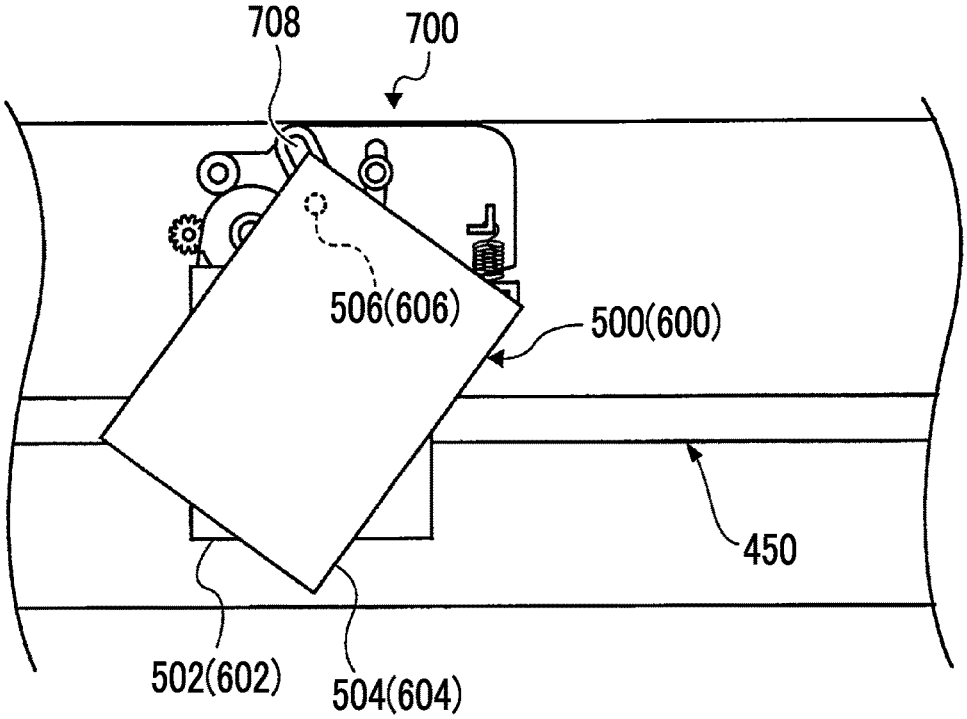

As shown in FIGS. 9A and 9B, the rotation mechanism 700 is arranged at a position adjacent to the guide rail 450, which is a position at which the guide pin 506 fixed to the rotating table 504 of the needle-attached binding device 500 and the guide pin 606 fixed to the rotating table 604 of the needleless binding device 600 are guided to the guide groove 708 as the needle-attached binding device 500 or the needleless binding device 600 moves.

In the rotation mechanism 700, as the needle-attached binding device 500 or the needleless binding device 600 that has moved on the guide rail 450 moves, the guide pins 506 and 606 fixed to the lower surfaces of the rotating tables 504 and 604 are guided to the guide groove 708 of the rotation mechanism 700, and the needle-attached binding device 500 or the needleless binding device 600 is rotated relative to the respective pedestals 502 and 602 via the rotating tables 504 and 604, such that the needle-attached binding device 500 or the needleless binding device 600 is rotated.

Furthermore, the biasing member 704 biases the rotation mechanism body 702 so that the needle-attached binding device 500 or the needleless binding device 600 that has moved to a preset position is rotated and is arranged at the position P4 that is the oblique binding position on the rear side.

The rotation mechanism 700 further has a drive source 710 and a cam 712 that is rotated by being driven by the drive source 710. The drive source 710 and the cam 712 are configured to move the rotation mechanism body 702 to a position such that the needle-attached binding device 500 or the needleless binding device 600 that has moved to a preset position is not rotated.

In a case where the cam 712 is rotated by being driven by the drive source 710, the side surface of the cam 712 comes into contact with the side wall of the guide groove 708 according to the shape of the cam 712, and the rotation mechanism body 702 is rotated around the shaft portion 706 as the rotation center and is retreated to a retreat position that is a position where the guide pins 506 and 606 are not guided by the guide groove 708. A cam mechanism for rotating the rotation mechanism body 702 and the guide groove 708 is constituted by the drive source 710 and the cam 712.

Figure 10A:
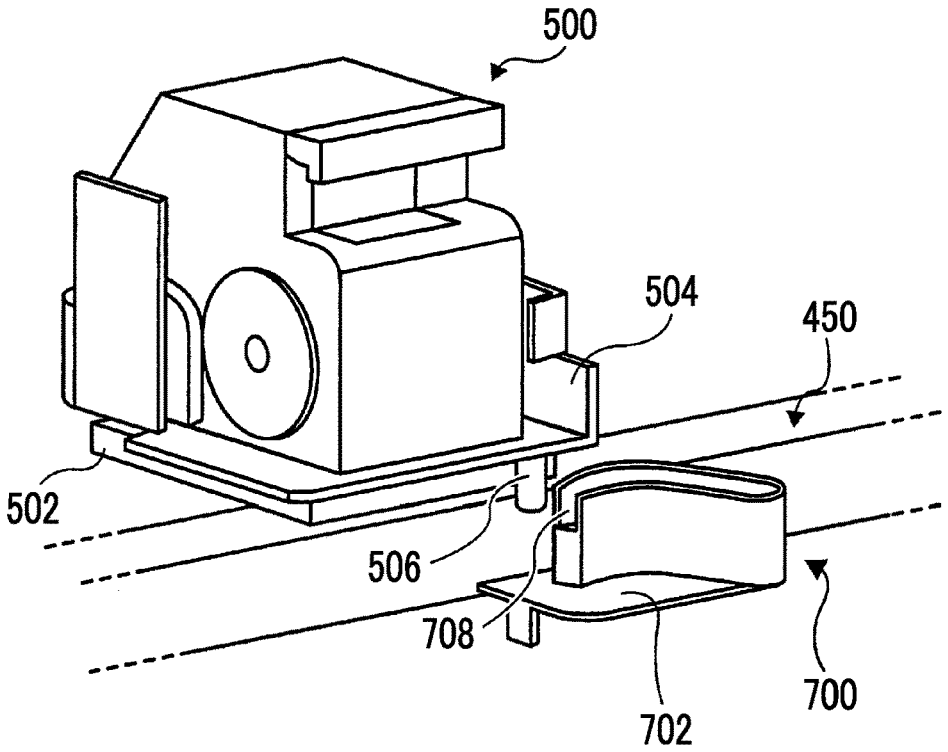
FIGS. 10A and 10B are schematic views describing an operation of a needle-attached binding device.
Figure 10B:
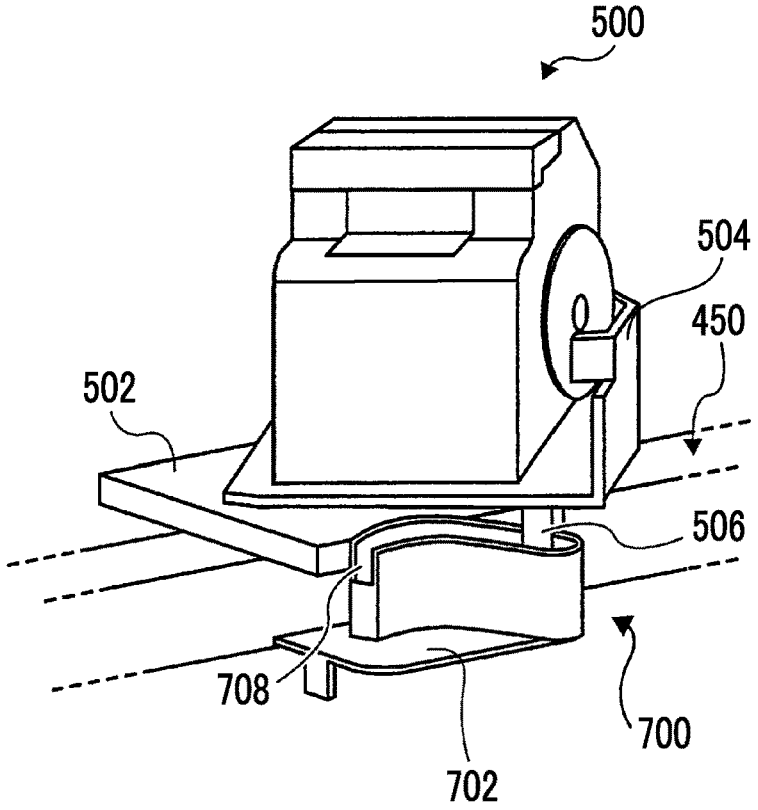

FIGS. 10A and 10B are schematic views describing an operation in a case where the needle-attached binding device 500 passes a position close to the rotation mechanism 700.

As shown in FIG. 10A, the needle-attached binding device 500 moves from the front side to the rear side along the guide rail 450.

Then, as shown in FIG. 10B, as the needle-attached binding device 500 moves, the guide pin 506 fixed to the rotating table 504 is received by the guide groove 708, and the received guide pin 506 moves along the R shape of the guide groove 708. Accordingly, the needle-attached binding device 500 is rotated obliquely, and the bundle of sheets P can be obliquely bound using the needles on the rear side.

Figure 11A:
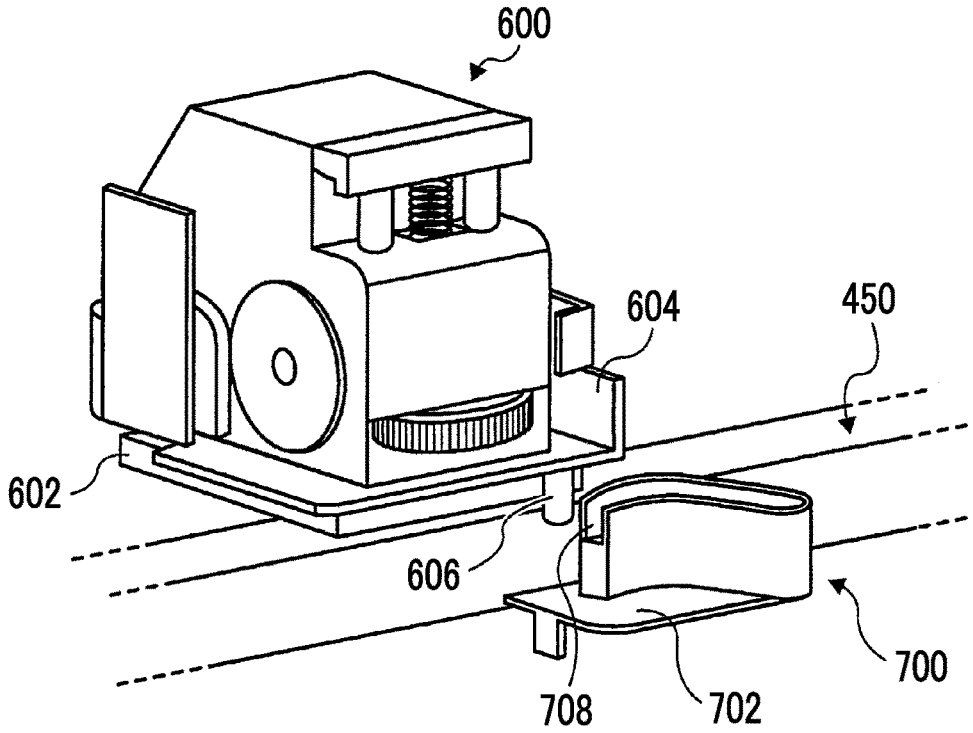
FIGS. 11A and 11B are schematic views describing the operation of a needleless binding device.
Figure 11B:
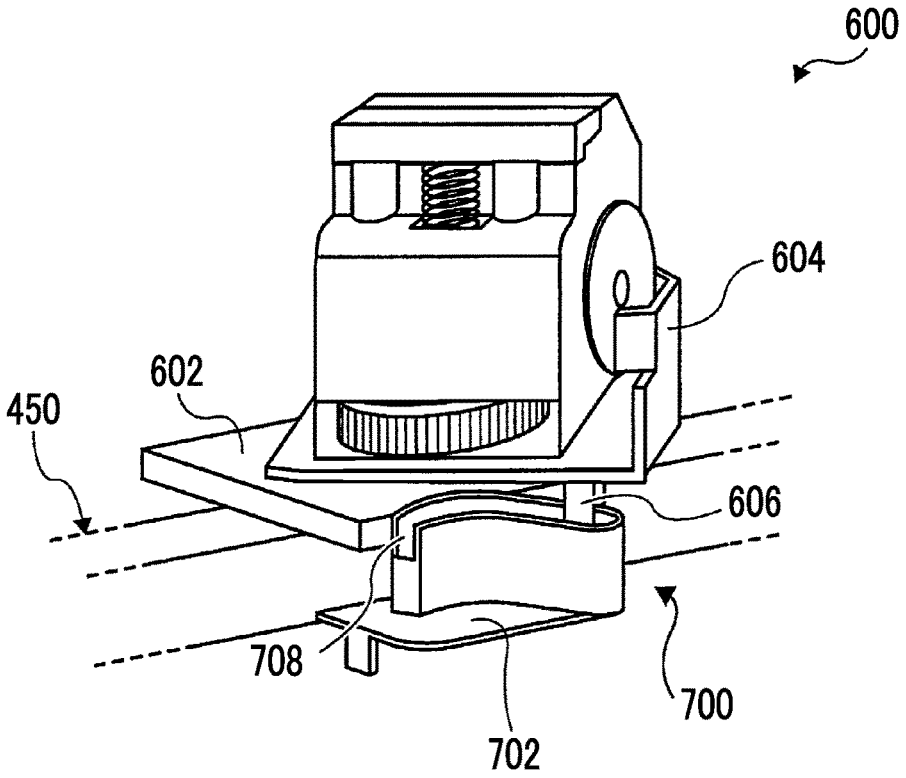

Similarly, as shown in FIG. 11A, the needleless binding device 600 moves from the front side to the rear side along the guide rail 450, and as shown in FIG. 11B, as the needleless binding device 600 moves, the guide pin 606 fixed to the rotating table 604 is received by the guide groove 708, and the received guide pin 606 moves along the R shape of the guide groove 708. Accordingly, the needleless binding device 600 is rotated obliquely, and the bundle of sheets P can be obliquely bound without using a needle on the rear side.

Figure 12A:
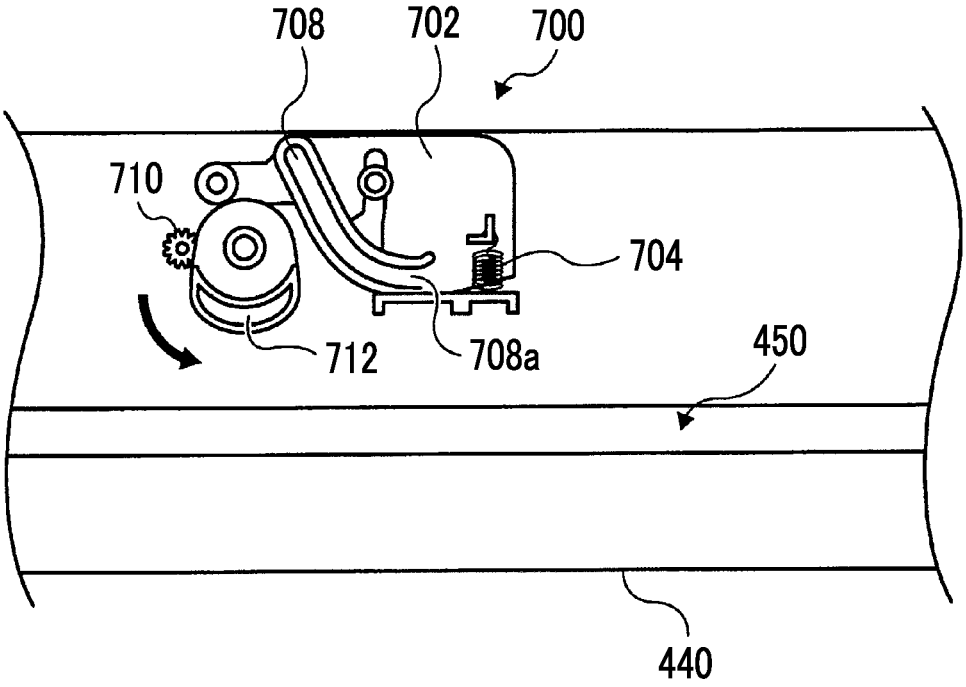
FIGS. 12A and 12B are schematic views describing an operation in a case where a rotation mechanism of the binding process unit in the present exemplary embodiment is moved to a retreat position.
Figure 12B:
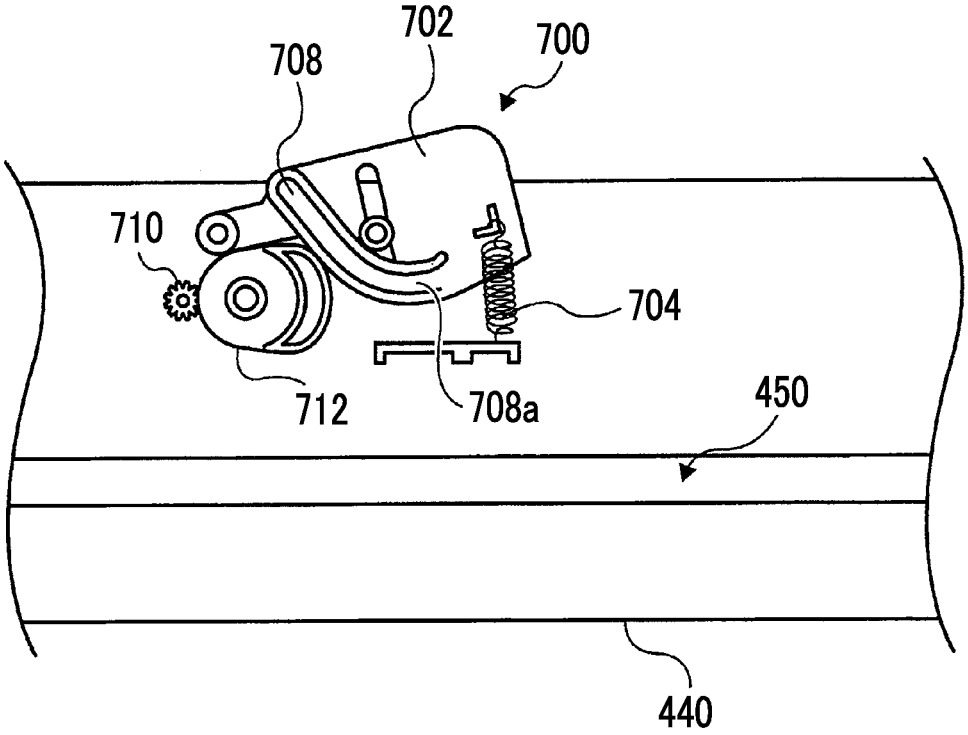

FIGS. 12A and 12B are schematic views describing an operation in a case where the rotation mechanism 700 is retreated to the retreat position that is the position where the guide pins 506 and 606 are not guided by the guide groove 708.

In a case where the binding process is performed using the binding device in the waiting place P5 or P6, the binding device not in the waiting place P5 or P6 is moved to the waiting place P5 or P6. In such a case, as shown in FIGS. 12A and 12B, the drive source 710 is driven counterclockwise, and the cam 712 is rotated counterclockwise by being driven by the drive source 710. Accordingly, even in a case where the needle-attached binding device 500 or the needleless binding device 600 passes a position close to the rotation mechanism 700 and moves to the preset position where the guide pin 506 or the guide pin 606 is guided to the guide groove 708, the guide groove 708 is retreated by the rotation of the cam 712 to a position where the guide pins 506 and 606 are not guided and the needle-attached binding device 500 or the needleless binding device 600 is not rotated. That is, the rotation mechanism 700 functions as a retreat mechanism for moving the guide groove 708 to the retreat position. Then, in a case where the cam 712 is rotated clockwise by being driven by the drive source 710, the rotation mechanism 700 is moved to a position where the needle-attached binding device 500 or the needleless binding device 600 that has moved to the preset position is rotated to the position P4, by the biasing force of the biasing member 704.

That is, by the rotation of the cam 712, the side surface of the cam 712 is brought into contact with the side wall of the guide groove 708 according to the shape of the cam 712, and the rotation mechanism body 702 is rotated around the shaft portion 706 as the rotation center and is moved to the retreat position that is a position where an opening portion 708*a* of the guide groove 708 is moved to the upper side in FIG. 12A and the guide pins 506 and 606 are not guided by the guide groove 708. Accordingly, the guide pins 506 and 606 are not guided to the guide groove 708 as the needle-attached binding device 500 and the needleless binding device 600 move, and the needle-attached binding device 500 or the needleless binding device 600 is moved to the waiting place P5 or P6 along the guide rail 450.

Figure 13:
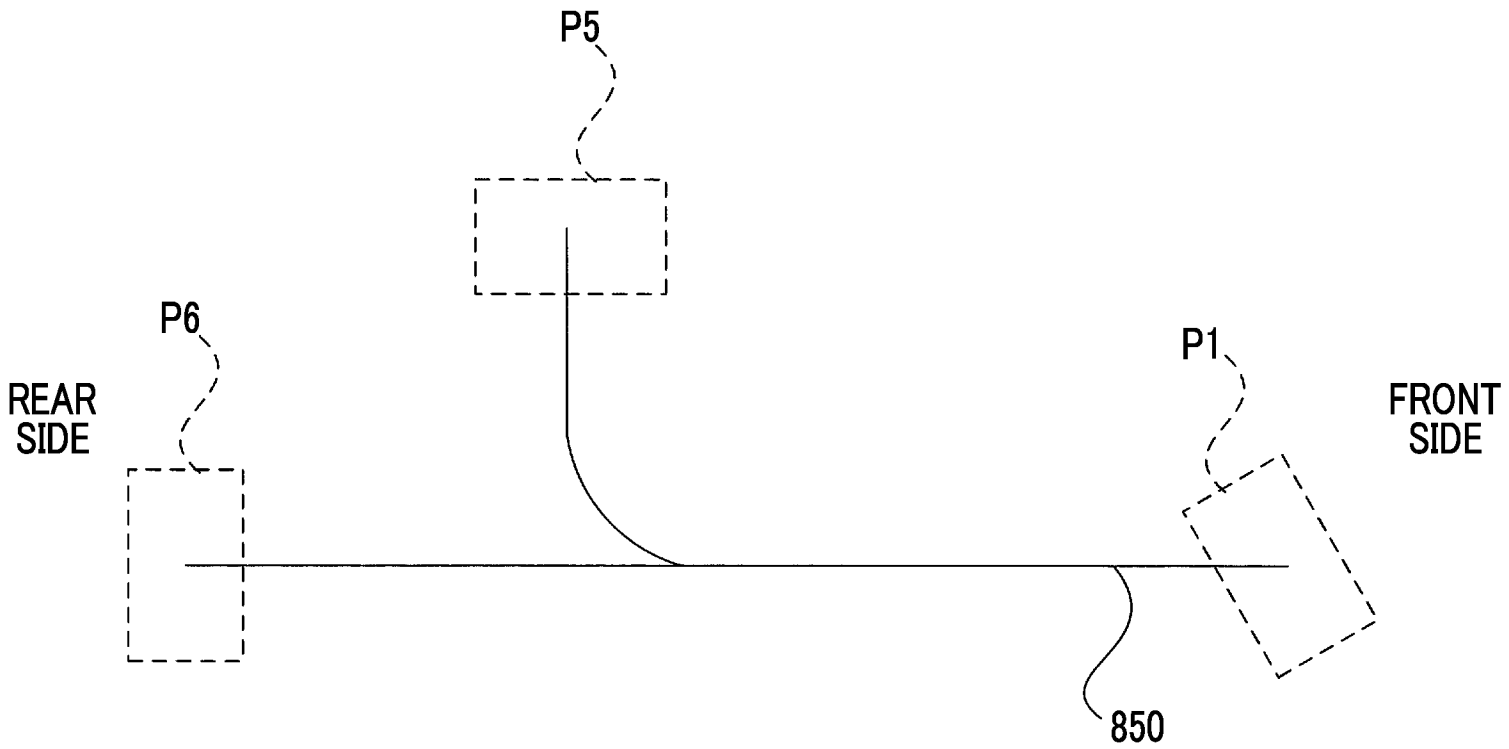
FIG. 13 is a schematic view for describing a modification example of the binding process unit in the present exemplary embodiment.

Next, a modification example of the binding process unit 400 described above will be described with reference to FIG. 13.

A guide rail 850 in this modification example is different in length and shape from the guide rail 450 in the binding process unit 400 of the exemplary embodiment described above. Specifically, the guide rail 850 of this modification example has a linear shape even on the front side, and the above-described rotation mechanism 700 is provided at a position adjacent to the guide rail 850 on the front side. Accordingly, even on the front side of the image forming apparatus 10, the needle-attached binding device 500 or the needleless binding device 600 can be rotated using the rotation mechanism 700 to perform oblique binding, so that the needle-attached binding device 500 can be replenished with needles. That is, even in a case where the guide rail has a linear shape, oblique binding can be performed on the front side, the length of the guide rail can be shortened, and a reduction in the size of the apparatus can be achieved.

In the image forming apparatus 10 described above, although the case where the needle-attached binding device 500 using a binding member (needle) is used as the first binding device, and the needleless binding device 600 that does not use a binding member (needle) is used as the second binding device is described as an example, the first binding device and the second binding device may both use a binding member, and for example, the binding members used may be of different types.

Further, in the image forming apparatus 10 described above, the binding process unit 400 provided with two binding devices has been described as an example, but the image forming apparatus 10 is not limited thereto, and is also applicable to a binding process unit provided with one binding device, and a binding process unit provided with three or more binding devices.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing apparatus comprising:

a binding device that performs a binding process on a bundle of sheets;

a guide rail for moving the binding device; and a rotation mechanism that is arranged at a position adjacent to the guide rail and rotates the binding device that has moved on the guide rail along with movement of the binding device, wherein the binding device is rotatably attached to a pedestal that moves on the guide rail via a rotating table, and the rotation mechanism obliquely rotates the binding device by causing a guide mechanism to receive a guide member provided in the binding device along with the movement of the binding device and causing the received guide member to move along the guide mechanism, wherein the guide member is a guide pin fixed to the rotating table, and the guide mechanism has a guide groove that guides the guide pin.

2. The post-processing apparatus according to claim 1, further comprising:

a retreat mechanism that retreats the rotation mechanism to a position where the binding device is not rotated even in a case where the binding device has moved to a preset position.

3. The post-processing apparatus according to claim 2, wherein the retreat mechanism includes a biasing member that biases the rotation mechanism to a position where the binding device that has moved to the preset position is rotated, and a cam mechanism that moves the rotation mechanism to a position where the binding device that has moved to the preset position is not rotated.

4. A post-processing apparatus comprising:

a first binding device that performs a binding process on a bundle of sheets;

a second binding device that performs a different binding process from the first binding device;

a guide rail for causing either one of the first binding device or the second binding device to wait at a waiting place and causing the other one to move; and a rotation mechanism that is arranged at a position adjacent to the guide rail and rotates the first binding device or the second binding device that has moved on the guide rail along with movement of the first binding device or the second binding device, wherein the first binding device is rotatably attached to a first pedestal that moves on the guide rail via a first rotating table, the second binding device is rotatably attached to a second pedestal that moves on the guide rail via a second rotating table, and the rotation mechanism obliquely rotates the first binding device by causing a guide mechanism to receive a first guide member provided in the first binding device along with the movement of the first binding device and causing the received first guide member to move along the guide mechanism, the rotation mechanism obliquely rotates the second binding device by causing the guide mechanism to receive a second guide member provided in the second binding device along with the movement of the second binding device and causing the received second guide member to move along the guide mechanism.

5. The post-processing apparatus according to claim 4, wherein the first binding device binds sheets using a binding member, and the second binding device binds sheets without using the binding member.

6. An image forming apparatus comprising:

an image forming portion that forms an image on a sheet; and a post-processing apparatus that binds a bundle of sheets on which an image is formed by the image forming portion, wherein the post-processing apparatus includes a binding device that performs a binding process on the bundle of sheets, a guide rail for moving the binding device, and a rotation mechanism that is arranged at a position adjacent to the guide rail and rotates the binding device that has moved on the guide rail along with movement of the binding device, wherein the binding device is rotatably attached to a pedestal that moves on the guide rail via a rotating table, and the rotation mechanism obliquely rotates the binding device by causing a guide mechanism to receive a guide member provided in the binding device along with the movement of the binding device and causing the received guide member to move along the guide mechanism, wherein the guide member is a guide pin fixed to the rotating table, and the guide mechanism has a guide groove that guides the guide pin.

* * * * *